US009494880B2

(12) United States Patent
Noguchi et al.

(10) Patent No.: US 9,494,880 B2
(45) Date of Patent: Nov. 15, 2016

(54) ELECTROPHOTOGRAPHIC PHOTOSENSITIVE MEMBER, METHOD OF PRODUCING ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Kazunori Noguchi, Suntou-gun (JP); Daisuke Tanaka, Yokohama (JP); Kazumichi Sugiyama, Numazu (JP); Yota Ito, Mishima (JP); Michiyo Sekiya, Atami (JP); Kunihiko Sekido, Suntou-gun (JP); Atsushi Okuda, Yokohama (JP); Nobuhiro Nakamura, Numazu (JP); Yuka Ishiduka, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/647,788

(22) PCT Filed: Nov. 18, 2013

(86) PCT No.: PCT/JP2013/081573

§ 371 (c)(1),
(2) Date: May 27, 2015

(87) PCT Pub. No.: WO2014/084149

PCT Pub. Date: Jun. 5, 2014

(65) Prior Publication Data

US 2015/0316865 A1 Nov. 5, 2015

(30) Foreign Application Priority Data

Nov. 30, 2012 (JP) ..... 2012-263255
Feb. 19, 2013 (JP) ..... 2013-030117
Oct. 22, 2013 (JP) ..... 2013-219644

(51) Int. Cl.
*G03G 5/14* (2006.01)
*G03G 5/05* (2006.01)
(Continued)

(52) U.S. Cl.
CPC ..... *G03G 5/0564* (2013.01); *G03G 5/0542* (2013.01); *G03G 5/0614* (2013.01);
(Continued)

(58) Field of Classification Search
CPC ..... G03G 5/14; G03G 5/142; G03G 5/144
See application file for complete search history.

(56) References Cited

U.S. PATENT DOCUMENTS 5,079,117 A * 1/1992 Koyama et al. ..... G03G 5/144 358/300
5,795,690 A 8/1998 Takegawa
(Continued)

FOREIGN PATENT DOCUMENTS

CN 1325039 A 12/2001
JP S62-239163 A 10/1987
(Continued)

*Primary Examiner* — Peter Vajda
(74) *Attorney, Agent, or Firm* — Canon U.S.A., Inc., IP Division

(57) ABSTRACT

The present invention relates to an electrophotographic photosensitive member including an undercoat layer containing metal oxide particles, a binder resin, and an organic acid metal salt having at least one metal element selected from the group consisting of bismuth, zinc, cobalt, iron, nickel, and copper.

18 Claims, 2 Drawing Sheets

(51) Int. Cl.
*G03G 5/06* (2006.01)
*G03G 5/147* (2006.01)

(52) U.S. Cl.
CPC ..... *G03G5/0696* (2013.01); *G03G 5/142* (2013.01); *G03G 5/144* (2013.01); *G03G 5/14708* (2013.01); *G03G 5/14726* (2013.01)

(56) References Cited

U.S. PATENT DOCUMENTS

| | | | |
|---|---|---|---|
| 6,143,453 | A | 11/2000 | Sugimura |
| 2003/0190540 | A1 | 10/2003 | Shoshi |
| 2008/0220356 | A1 | 9/2008 | Yamada |

FOREIGN PATENT DOCUMENTS

| | | | | | |
|---|---|---|---|---|---|
| JP | H02-280170 | A | | 11/1990 | |
| JP | H07225449 | A | | 8/1995 | |
| JP | H08-262776 | A | | 10/1996 | |
| JP | H09-197701 | A | | 7/1997 | |
| JP | 2004-219904 | A | | 8/2004 | |
| JP | 2005-010662 | | * | 1/2005 | ..... G03G 5/14 |
| JP | 2005-10662 | A | | 1/2005 | |
| JP | 2006-30700 | A | | 2/2006 | |
| JP | 2008-065171 | A | | 3/2008 | |
| JP | 2008-217016 | A | | 9/2008 | |
| JP | 2008220356 | A | | 9/2008 | |

* cited by examiner

ELECTROPHOTOGRAPHIC PHOTOSENSITIVE MEMBER, METHOD OF PRODUCING ELECTROPHOTOGRAPHIC PHOTOSENSITIVE MEMBER, PROCESS CARTRIDGE, AND ELECTROPHOTOGRAPHIC APPARATUS

TECHNICAL FIELD

The present invention relates to an electrophotographic photosensitive member, a method of producing the electrophotographic photosensitive member, and a process cartridge and an electrophotographic apparatus each including the electrophotographic photosensitive member.

BACKGROUND ART

In an electrophotographic photosensitive member used in an electrophotographic apparatus, an undercoat layer containing metal oxide particles is disposed between a support and a photosensitive layer. The metal oxide particles are surface-treated with a silane coupling agent for preventing image defects of black spots due to charge injection from the support to the photosensitive layer.

Recently, the requirement for a reduction in variation of light potential of an electrophotographic photosensitive member in repeating use has been increased than ever before in association with speed-up (acceleration of process speed) of electrophotographic apparatuses. In particular, in an undercoat layer containing surface-treated metal oxide particles, the resistance of the undercoat layer is increased, and the potential (such as light potential) is apt to significantly vary in repeating use.

As technologies of preventing the variation in light potential of an electrophotographic photosensitive member, PTL 1 describes an undercoat layer containing zinc oxide particles provided with an acceptor compound (organic compound); PTL 2 describes an undercoat layer containing metal oxide particles having surfaces provided with a dye (organic compound) that absorbs light in a wavelength range of 450 to 950 nm; and PTL 3 discloses a plurality of undercoat layers containing a silane coupling agent such that the concentration of the silane coupling agent in the undercoat layer on the support side is higher than others.

Unfortunately, investigation by the present inventors resulted in that the technologies disclosed in PTLs 1 to 3 have the following problems: Though the variation in light potential can be sufficiently prevented in repeating use under an ordinary temperature and ordinary humidity (23° C./50% RH) environment, the variation in light voltage cannot be sufficiently prevented in repeating use under a high temperature and high humidity (30° C./85% RH) environment in some cases.

CITATION LIST

Patent Literature

PTL 1 Japanese Patent Laid-Open No. 2006-30700
PTL 2 Japanese Patent Laid-Open No. 2004-219904
PTL 3 Japanese Patent Laid-Open No. 2008-065171

SUMMARY OF INVENTION

The present invention provides an electrophotographic photosensitive member showing a small difference between the variation in light potential by repeating use under an ordinary temperature and ordinary humidity and the variation in light potential by repeating use under a high temperature and high humidity and provides a method of producing such an electrophotographic photosensitive member. The present invention also provides a process cartridge and an electrophotographic apparatus each having the electrophotographic photosensitive member.

The present invention relates to an electrophotographic photosensitive member comprising a support, an undercoat layer disposed on the support, and a photosensitive layer disposed on the undercoat layer, wherein the undercoat layer contains: metal oxide particles whose surfaces have been treated with a silane coupling agent; a binder resin; and an organic acid metal salt having at least one metal element selected from the group consisting of bismuth, zinc, cobalt, iron, nickel, and copper.

The present invention also relates to a process cartridge detachably attachable to a main body of an electrophotographic apparatus, wherein the process cartridge integrally supports the electrophotographic photosensitive member and at least one device selected from the group consisting of charging devices, developing devices, transferring devices, and cleaning devices.

The present invention also relates to an electrophotographic apparatus comprising the electrophotographic photosensitive member, a charging device, an exposing device, a developing device, and a transferring device.

The present invention also relates to a method of producing an electrophotographic photosensitive member including a support, an undercoat layer disposed on the support, and a photosensitive layer disposed on the undercoat layer, the method comprising the steps of: preparing a coating liquid for an undercoat layer containing: metal oxide particles whose surfaces have been treated with a silane coupling agent, a blocked isocyanate compound, a polyol, and an organic acid metal salt having at least one metal element selected from the group consisting of bismuth, zinc, cobalt, iron, nickel, and copper; and forming a coating film of the coating liquid for an undercoat layer, and drying and curing the coating film to form the undercoat layer.

The present invention can provide an electrophotographic photosensitive member showing a small difference between the variation in light potential by repeating use under an ordinary temperature and ordinary humidity and the variation in light potential by repeating use under a high temperature and high humidity and can provide a method of producing such an electrophotographic photosensitive member. The present invention can also provide a process cartridge and an electrophotographic apparatus each including the electrophotographic photosensitive member.

DESCRIPTION OF EMBODIMENTS

Figure 1A:
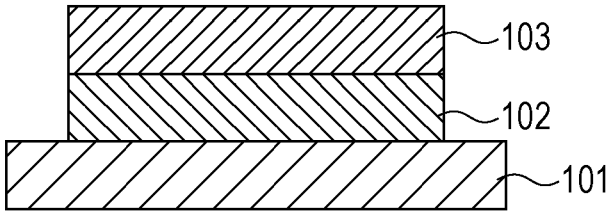
FIGS. 1A and 1B are diagrams showing an example of the layer structure of an electrophotographic photosensitive member.

The electrophotographic photosensitive member according to the present invention includes an undercoat layer between a support and a photosensitive layer. The undercoat layer contains metal oxide particles, a binder resin, and an organic acid metal salt (organic acid metal) having at least one metal element selected from the group consisting of bismuth, zinc, cobalt, iron, nickel, and copper.

The undercoat layer containing metal oxide particles whose surfaces have been treated with a silane coupling agent and the above-mentioned specific organic acid metal salt can reduce the difference between the variation in light potential by repeating use under an ordinary temperature and ordinary humidity and the variation in light potential by repeating use under a high temperature and high humidity. The present inventors presume the reasons for this as follows.

The metal oxide particles express an electron-transporting property by the oxygen-deficient portions of the metal oxide particles.

However, the repeating use of the electrophotographic photosensitive member allows moisture in the air to adsorb in the oxygen-deficient portions of the metal oxide particles, resulting in a decrease in the electron-transporting property of the metal oxide particles to increase the resistance of the undercoat layer compared to that before the repeating use. Consequently, the repeating use causes a variation (change) in the light potential of the electrophotographic photosensitive member.

In particular, since the air under a high temperature and high humidity environment contains a large amount of moisture, the moisture in the air tends to readily adsorb in the oxygen-deficient portions of the metal oxide particles to readily increase the degree of variation (change) in the light potential of the electrophotographic photosensitive member with repeating use. The adsorption of moisture in the air can be prevented from increasing the amount of a silane coupling agent for surface treatment of the metal oxide particles, but the increase allows the electrophotographic properties to readily decrease.

Accordingly, the present inventors have investigated and revealed that the difference between the variation in light potential of an electrophotographic photosensitive member under an ordinary temperature and ordinary humidity and the variation in light potential of the electrophotographic photosensitive member under a high temperature and high humidity can be reduced by using an undercoat layer containing a specific organic acid metal salt. This suggests that the specific organic acid metal salt prevents adsorption of moisture into the oxygen-deficient portions of the metal oxide particles.

The specific organic acid metal salt has mobility of the organic acid part and intramolecular polarity. Accordingly, it is presumed that the specific organic acid metal salt draws moisture in the air than the metal oxide particles do and, as a result, prevents moisture from adsorbing into the oxygen-deficient portions of the metal oxide particles.

Examples of the metal oxide particles contained in the undercoat layer include particles containing metal oxides such as titanium oxide, zinc oxide, tin oxide, zirconium oxide, or aluminum oxide. In particular, from the viewpoint of preventing the variation in light potential, particles containing at least one metal oxide selected from the group consisting of titanium oxide, zinc oxide, and tin oxide (titanium oxide particles, zinc oxide particles, or tin oxide particles) can be used.

In addition, from the viewpoint of preventing occurrence of image defects of black spots (black dots) due to charge injection (e.g., hole injection) from the support to the photosensitive layer, the surfaces of the metal oxide particles contained in the undercoat layer should be treated (surface treatment) with a surface treatment agent such as a silane coupling agent.

The silane coupling agent can be an aminosilane coupling agent. Examples of the silane coupling agent include N-2-(aminoethyl)-3-aminopropylmethyldimethoxysilane, 3-aminopropylmethyldiethoxysilane, (phenylaminomethyl) methyldimethoxysilane, N-2-(aminoethyl)-3-aminoisobutylmethyldimethoxysilane, N-ethylaminoisobutylmethyldiethoxysilane, N-methylaminopropylmethyldimethoxysilane, vinyltrimethoxysilane, 3-aminopropyltriethoxysilane, N-(2-aminoethyl)-3-aminopropyltrimethoxysilane, methyltrimethoxysilane, 3-glycidoxypropyltrimethoxysilane, 3-methacryloxypropyltrimethoxysilane, 3-chloropropyltrimethoxysilane, and 3-mercaptopropyltrimethoxysilane.

Examples of the binder resin contained in the undercoat layer include acrylic resins, allyl resins, alkyd resins, ethyl cellulose resins, ethylene-acrylic acid copolymers, epoxy resins, casein resins, silicone resins, gelatin resins, phenol resins, urethane resins, butyral resins, melamine resins, polyacrylates, polyacetals, polyamide imides, polyamides, polyallyl ethers, polyimides, polyesters, polyethylenes, polycarbonates, polystyrenes, polysulfones, polyvinyl alcohols, polybutadienes, and polypropylenes. In particular, from the viewpoint of preventing the dependence on environment (dependence on humidity) of the variation in light potential, the urethane resins can be particularly used. These binder resins may be used alone or in combination of two or more thereof.

The urethane resin is usually synthesized from an isocyanate compound and a polyol (polyol resin).

Examples of the isocyanate compound for preparing the urethane resin include 2,4-tolylene diisocyanate, 2,6-tolylene diisocyanate, diphenylmethane-4,4'-diisocyanate, 1-isocyanato-3,3,5-trimethyl-5-isocyanatomethylcyclohexane (isophorone diisocyanate, IPDI), hexamethylene diisocyanate (HDI), HDI-trimethylolpropane adduct products, HDI-isocyanurate products, and HDI-biuret products. In particular, from the viewpoints of enhancing the crosslinking density of the urethane resin and preventing the adsorption of moisture to the metal oxide particles, aliphatic diisocyanates such as hexamethylene diisocyanate and isophorone diisocyanate can be used. These isocyanate compounds may be used alone or in combination of two or more thereof. Furthermore, from the viewpoint of controlling the reaction of the isocyanate compound, the isocyanate group of the isocyanate compound may be blocked with a blocking agent, i.e., a blocked isocyanate compound can be used.

Examples of the blocking agent for blocking the isocyanate group of an isocyanate compound include oxime compounds, such as formaldehyde oxime, acetaldoxime, methyl ethyl ketoxime, cyclohexanone oxime, acetone oxime, and methyl isobutyl ketoxime, and derivatives thereof; active methylene compounds, such as Meldrum's acid, dimethyl malonate, diethyl malonate, di-n-butyl malonate, ethyl acetate, and acetylacetone, and derivatives thereof; amine compounds, such as diisopropylamine, diphenylaniline, aniline, and carbazole, and derivatives thereof; imine compounds, such as ethyleneimine and polyethyleneimine, and derivatives thereof; imide compounds, such as succinimide and maleinimide, and derivatives thereof; imidazole compounds, such as malonate, imidazole, benzimidazole, and 2-methylimidazole, and derivatives thereof; triazole compounds, such as 1,2,3-triazole, 1,2,4-triazole, 4-amino-1,2,4-triazole, and benzotriazole, and derivatives thereof; acid amide compounds, such as acetoanilide, N-methylacetamide, and acetic acid amide, and derivatives thereof; lactam compounds, such as ϵ-caprolactam, δ-valerolactam, and γ-butyrolactam, and derivatives thereof; urea compounds, such as urea, thiourea, and ethylene urea, and derivatives thereof; sulfites such as sodium bisulfite; mercaptan compounds, such as butyl mercaptan and dodecyl mercaptan, and derivatives thereof; phenol compounds, such as phenol and cresol, and derivatives thereof; pyrazole compounds, such as pyrazole, 3,5-dimethylpyrazole, and 3-methylpyrazole, and derivatives thereof; and alcohol compounds, such as methanol, ethanol, 2-propanol, and n-butanol, and derivatives thereof. These blocking agents may be used alone or in combination of two or more thereof. In particular, the blocking agent can be an oxime compound or a derivative thereof, a pyrazole compound or a derivative thereof, or a lactam compound or a derivative thereof. In particular, the blocking agent can be a pyrazole compound or a derivative thereof or a lactam compound or a derivative thereof.

Examples of the polyol for preparing the urethane resin include polyvinyl acetal, polyphenol, polyethylene diol, polycarbonate diol, polyether polyol, and polyacryl polyol. In particular, polyvinyl acetal can be used. These polyol resins may be used alone or in combination of two or more thereof.

The undercoat layer contains at least one organic acid metal salt selected from the group consisting of organic acid bismuth salts, organic acid zinc salts, organic acid cobalt salts, organic acid iron salts, organic acid nickel salts, and organic acid copper salts. Furthermore, from the viewpoint of preventing the variation in light potential, the organic acid of the organic acid metal salt can be a monovalent carboxylic acid such as octylic acid, naphthenic acid, or salicylic acid.

Examples of the organic acid bismuth salt include bismuth octylate (bismuth octanoate), bismuth naphthenate, and bismuth salicylate. Examples of the organic acid zinc salt include zinc octylate (zinc octanoate), zinc naphthenate, and zinc salicylate. Examples of the organic acid cobalt salt include cobalt octylate (cobalt octanoate), cobalt naphthenate, and cobalt salicylate. Examples of the organic acid iron salt include iron octylate (iron octanoate), iron naphthenate, and iron salicylate. Examples of the organic acid nickel salt include nickel octylate (nickel octanoate), nickel naphthenate, and nickel salicylate. Examples of the organic acid copper salt include copper octylate (copper octanoate), copper naphthenate, and copper salicylate. In particular, bismuth octylate, zinc octylate, cobalt octylate, iron octylate, bismuth naphthenate, zinc naphthenate, cobalt naphthenate, iron naphthenate, nickel octylate, nickel naphthenate, and copper naphthenate can be used. More particularly, bismuth octylate, zinc octylate, cobalt octylate, iron octylate, and nickel octylate can be used. Most particularly, bismuth octylate and zinc octylate can be used. These organic acid metal salts may be used alone or in combination of two or more (including those of the same metal element having different valence states) thereof.

The specific organic acid metal salt is also available commercially. Examples of commercially available products include zinc octylate (trade name: Nikkaoctics Zinc Zn 8%), bismuth octylate (trade name: PUCAT 25 Bi 25%), cobalt octylate (trade name: Nikkaoctics Cobalt), iron octylate (trade name: Nikkaoctics Iron), zinc naphthenate (trade name: Naphthecs Zinc), bismuth naphthenate (trade name: PUCAT B7), cobalt naphthenate (trade name: Naphthecs Cobalt), iron naphthenate (trade name: Naphthecs Iron), nickel octylate (trade name: Nikkaoctics Nickel), and copper naphthenate (trade name: Naphthecs Copper Cu 5%) manufactured by Nihon Kagaku Sangyo Co., Ltd. In these products of Nihon Kagaku Sangyo Co., Ltd., iron octylate (trade name: Nikkaoctics Iron) is a mixture of iron(II) octylate and iron(III) octylate, and bismuth octylate (trade name: PUCAT 25 Bi 25%) is a mixture of bismuth(II) octylate and bismuth (III) octylate.

The ratio (mass ratio) of the metal oxide particles to the binder resin (metal oxide particles/binder resin) contained in the undercoat layer should be 1/1 or more, from the viewpoint of preventing the variation in light potential. In other words, the amount of metal oxide particles contained in the undercoat layer should be 100% by mass or more based on the amount of the binder resin contained in the undercoat layer. At the same time, from the viewpoint of preventing occurrence of cracks in the undercoat layer, the ratio (mass ratio) of the metal oxide particles to the binder resin (metal oxide particles/binder resin) contained in the undercoat layer should be 4/1 or less. In other words, the amount of metal oxide particles contained in the undercoat layer should be 400% by mass or less based on the amount of the binder resin contained in the undercoat layer. That is, the mass ratio should be 1/1 or more and 4/1 or less.

The ratio (mass ratio) of the specific organic acid metal salt to the metal oxide particles (organic acid metal salt/metal oxide particles) contained in the undercoat layer can be 1/200 or more and 2/10 or less, from the viewpoint of preventing the variation in light potential. In other words, the amount of the specific organic acid metal salt contained in the undercoat layer should be 0.5% by mass or more and 20% by mass or less based on the amount of the metal oxide particles contained in the undercoat layer.

In the case of using two or more types of metal oxide particles, resin binders, or specific organic acid metal salts, the ratios mentioned above are those on the basis of the total mass of them.

As described above, the electrophotographic photosensitive member of the present invention includes a support, an undercoat layer disposed on the support, and a photosensitive layer disposed on the undercoat layer.

Figure 1B:
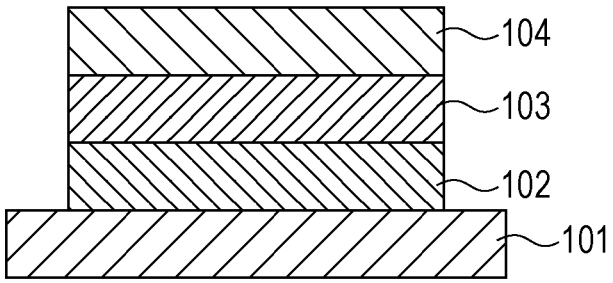

FIGS. 1A and 1B show an example of the layer structure of the electrophotographic photosensitive member of the present invention. In FIGS. 1A and 1B, reference number 101 denotes a support, reference number 102 denotes an undercoat layer, reference number 103 denotes a photosensitive layer, and reference number 104 denotes a protective layer.

The photosensitive layer can be a multi-layered photosensitive layer composed of a charge-generating layer containing a charge-generating material and a charge-transporting layer containing a charge-transporting material in this order from the undercoat layer side. The charge-transporting material contained in the charge-transporting layer can be a hole-transporting material.

The support can be electrically conductive (electrically conductive support), and examples of the support include those made of metals (alloys) such as aluminum, aluminum alloys, stainless steel, copper, nickel, and zinc. As a support of aluminum or an aluminum alloy, for example, an ED tube or an EI tube can be used.

In addition, a metal support or a resin support provided with an electrically conductive thin film of aluminum, an aluminum alloy, or an indium oxide-tin oxide alloy thereon can be used.

The surface of a support may be subjected to cutting, roughing, alumite treatment, combined electropolishing, wet honing, or dry honing for preventing occurrence of interference fringes due to scattering of laser beams. The combined electropolishing is composed of electrophoresis by an electrode having electrolytic activity and an electrolyte solution and polishing with a grindstone having polishing activity.

In order to prevent occurrence of interference fringes due to scattering of laser beams or to mask (cover) scratches of a support, an electrically conductive layer may be disposed between the support and the undercoat layer.

The electrically conductive layer can be formed by forming a coating film by application of a coating liquid for an electrically conductive layer prepared by dispersing electrically conductive particles such as carbon black, metal particles, or metal oxide particles and a binder resin in a solvent; and drying the resulting coating film.

The dispersing is performed by, for example, a method using a homogenizer, an ultrasonic disperser, a ball mill, a sand mill, a roll mill, a vibration mill, an attritor, or a liquid collision-type high-speed disperser.

Examples of the binder resin contained in the electrically conductive layer include polyesters, polycarbonates, polyvinyl butyrals, acrylic resins, silicone resins, epoxy resins, melamine resins, urethane resins, phenol resins, and alkyd resins. These binder resins may be used alone or as a mixture or copolymer of two or more thereof.

Examples of the solvent used in the coating liquid for an electrically conductive layer include ether solvents, alcohol solvents, ketone solvents, and aromatic hydrocarbon solvents. These solvents may be used alone or in combination of two or more thereof.

The electrically conductive layer can have a thickness of 5 μm or more and 40 μm or less, preferably, 10 μm or more and 30 μm or less.

The undercoat layer described above is disposed between the support or the electrically conductive layer and the photosensitive layer (charge-generating layer and charge-transporting layer).

The undercoat layer can be formed by forming a coating film by application of a coating liquid for an undercoat layer prepared by dispersing metal oxide particles, a binder resin, and a specific organic acid metal salt in a solvent onto a support; and drying and/or curing the resulting coating film.

The dispersing is performed by, for example, a method using a homogenizer, an ultrasonic disperser, a ball mill, a sand mill, a roll mill, a vibration mill, an attritor, or a liquid collision-type high-speed disperser.

Examples of the solvent that is used for preparing the coating liquid for an undercoat layer include alcohol solvents, ketone solvents, ether solvents, ester solvents, halogenated hydrocarbon solvents, and aromatic hydrocarbon solvents. Specific examples of the solvent include methylal, tetrahydrofuran, methanol, ethanol, isopropyl alcohol, butyl alcohol, methyl cellosolve, methoxypropanol, acetone, methyl ethyl ketone, cyclohexane, methyl acetate, ethyl acetate, dioxane, and tetrahydrofuran. These solvents may be used alone or in combination of two or more thereof.

The undercoat layer may contain organic resin particles or a leveling agent. Examples of the organic resin particles contained in the undercoat layer include hydrophobic organic resin particles such as silicone particles and hydrophilic organic resin particles such as cross-linking polymethyl methacrylate (PMMA) particles.

The undercoat layer can contain various additives for improving the electric characteristics, film morphology stability, or image quality.

Examples of the additives contained in the undercoat layer include metal particles such as aluminum particles and copper particles; electrically conductive particles such as carbon black; electron-transporting materials such as quinone compounds, fluorenone compounds, oxadiazole compounds, diphenoquinone compounds, alizarin compounds, benzophenone compounds, polycyclic fused compounds, and azo compounds; metal chelate compounds; and silane coupling agents.

The heating temperature (drying temperature) of the coating film of the coating liquid for an undercoat layer should be 100° C. or more and 190° C. or less from the viewpoint of preventing occurrence of cracks in the undercoat layer and the viewpoint of strength of the binder resin of the undercoat layer. In particular, when the binder resin of the undercoat layer is a urethane resin, the heating temperature (drying temperature) of the coating film of the coating liquid for an undercoat layer should be 130° C. or more and 170° C. or less from the viewpoint of preventing occurrence of cracks in the undercoat layer and the viewpoint of the curing property. In addition, when the binder resin of the undercoat layer is a urethane resin, the heating time (drying time) of the coating film of the coating liquid for an undercoat layer should be 10 min or more and 120 min or less from the same viewpoints.

The undercoat layer can have a thickness of 0.5 μm or more and 40 μm or less, preferably, 0.5 μm or more and 10 μm or less.

When the electrically conductive layer is not provided, the thickness of the undercoat layer should be 10 μm or more, preferably 15 μm or more, from the viewpoint of masking (covering) scratches of the support, but should be 40 μm or less, preferably 35 μm or less.

On the undercoat layer, a photosensitive layer (charge-generating layer and charge-transporting layer) is provided.

When the photosensitive layer is a multi-layered photosensitive layer, the charge-generating layer can be formed by applying a coating liquid for a charge-generating layer prepared by dispersing a charge-generating material and a binder resin in a solvent; and drying the resulting coating film. The charge-generating layer may be an evaporated film of a charge-generating material.

The dispersing is performed by, for example, a method using a homogenizer, an ultrasonic disperser, a ball mill, a sand mill, a roll mill, a vibration mill, an attritor, or a liquid collision-type high-speed disperser.

Examples of the charge-generating material include azo pigments, phthalocyanine pigments, indigo pigments, perylene pigments, polycyclic quinone pigments, squarylium colorants, thiapyrylium salts, triphenylmethane colorants, quinacridone pigments, azulenium salt pigments, cyanine dyes, anthanthrone pigments, pyranthrone pigments, xanthene colorants, quinone imine colorants, and styryl colorants. In particular, from the viewpoint of sensitivity, oxytitanium phthalocyanine, chlorogallium phthalocyanine, or hydroxygallium phthalocyanine, more particularly, hydroxygallium phthalocyanine can be used. The hydroxygallium phthalocyanine can have a crystal form exhibiting strong peaks at a Bragg angle 2θ (±0.3°) of 7.4° (±0.3°) and a Bragg angle 2θ (±0.3°) of 28.2° (±0.3°) in the CuKα characteristic X-ray diffraction. These charge-generating materials may be used alone or in combination of two or more thereof.

When the photosensitive layer is a multi-layered photosensitive layer, examples of the binder resin contained in the charge-generating layer include polycarbonates, polyesters, butyral resins, polyvinyl acetals, acrylic resins, vinyl acetate resins, and urea resins. In particular, butyral resins can be used. These binder resins may be used alone or as a mixture or copolymer of two or more thereof.

Examples of the solvent used in the coating liquid for a charge-generating layer include alcohol solvents, sulfoxide solvents, ketone solvents, ether solvents, ester solvents, and aromatic hydrocarbon solvents. These solvents may be used alone or in combination of two or more thereof.

The charge-generating layer can have a thickness of 0.01 μm or more and 5 μm or less, preferably, 0.1 μm or more and 2 μm or less.

The charge-generating layer can optionally contain various additives such as a sensitizer, an antioxidant, an ultraviolet absorber, and a plasticizer.

In the electrophotographic photosensitive member having a multi-layered photosensitive layer, a charge-transporting layer is disposed on the charge-generating layer.

The charge-transporting layer can be formed by application of a coating liquid for a charge-transporting layer prepared by dissolving a charge-transporting material and a binder resin in a solvent; and drying the resulting coating film.

The charge-transporting material is roughly classified into a hole-transporting material and an electron-transporting material. Examples of the hole-transporting material include triarylamine compounds, hydrazone compounds, styryl compounds, stilbene compounds, and butadiene compounds. In particular, triarylamine compounds can be used. These charge-transporting materials may be used alone or in combination of two or more thereof.

When the photosensitive layer is a multi-layered photosensitive layer, examples of the binder resin contained in the charge-transporting layer include acrylic resins, acrylonitrile resins, allyl resins, alkyd resins, epoxy resins, silicone resins, phenol resins, phenoxy resins, polyacryl amides, polyamide imides, polyamides, polyallyl ethers, polyarylates, polyimides, urethane resins, polyesters, polyethylenes, polycarbonates, polysulfones, polyphenylene oxides, polybutadienes, polypropylenes, and methacrylic resins. In particular, polyarylates and polycarbonates can be used. These binder resins may be used alone or as a mixture or copolymer of two or more thereof.

Examples of the solvent used in the coating liquid for a charge-transporting layer include alcohol solvents, sulfoxide solvents, ketone solvents, ether solvents, ester solvents, and aromatic hydrocarbon solvents. These solvents may be used alone or in combination of two or more thereof.

The ratio (mass ratio) of the charge-transporting material to the binder resin (charge-transporting material/binder resin) contained in the charge-transporting layer can be 0.3/1 or more and 10/1 or less.

The heating temperature (drying temperature) of the coating film of the coating liquid for a charge-transporting layer can be 60° C. or more and 150° C. or less, preferably, 80° C. or more and 120° C. or less. The heating time (drying time) can be 10 min or more and 60 min or less.

When the charge-transporting layer of the electrophotographic photosensitive member is a monolayer, the thickness of the charge-transporting layer can be 5 μm or more and 40 μm or less, preferably, 8 μm or more and 30 μm or less.

When the charge-transporting layer has a multi-layer structure, the thickness of the charge-transporting layer on the support side can be 5 μm or more and 30 μm or less, and the thickness of the charge-transporting layer on the surface side can be 1 μm or more and 10 μm or less.

The charge-transporting layer can optionally contain an antioxidant, an ultraviolet absorber, a plasticizer, or other additives.

In the present invention, a protective layer may be disposed on the photosensitive layer (charge-transporting layer) for improving the durability and the cleaning property of the electrophotographic photosensitive member.

The protective layer can be formed by applying a coating liquid for a protective layer prepared by dissolving a resin (or its monomer and/or oligomer) in a solvent; and drying and/or curing the resulting coating film.

Examples of the resin contained in the protective layer include polyvinyl butylals, polyesters, polycarbonates, polyamides, polyimides, polyacrylates, urethane resins, acrylic resins, methacrylic resins, styrene-butadiene copolymers, styrene-acrylic acid copolymers, and styrene-acrylonitrile copolymers. In particular, acrylic resins and methacrylic resins can be used. These resins may be used alone or in combination of two or more thereof.

Alternatively, a protective layer (second charge-transporting layer) having a charge-transporting property may be formed by curing a monomer having charge-transporting ability (hole-transporting ability) by various polymerization or cross-linking reactions. Specifically, a protective layer (second charge-transporting layer) can be formed by polymerizing or cross-linking a charge-transporting compound (hole-transporting compound) having chain-polymerizable functional groups and curing the polymerized or cross-linked compound.

Examples of the chain-polymerizable functional group include acryloyloxy, methacryloyloxy, alkoxysilyl, and epoxy groups. Examples of the curing reaction include radical polymerization reaction and ionic polymerization reaction. The curing reaction can use, for example, heat, light such as ultraviolet rays, or radiation such as electron rays.

Furthermore, the protective layer can optionally contain electrically conductive particles, an ultraviolet absorber, or an abrasion resistance modifier. Examples of the electrically conductive particles include metal oxide particles such as tin oxide particles. Examples of the abrasion resistance modifier include fluorine-containing resin particles such as polytetrafluoroethylene particles; alumina; and silica.

The protective layer can have a thickness of 0.5 μm or more and 20 μm or less, preferably, 1 μm or more and 10 μm or less.

The application of the coating liquid for each layer can be performed by, for example, dip application (dip coating), spray coating, spinner coating, roller coating, Meyer bar coating, or blade coating.

Figure 2:
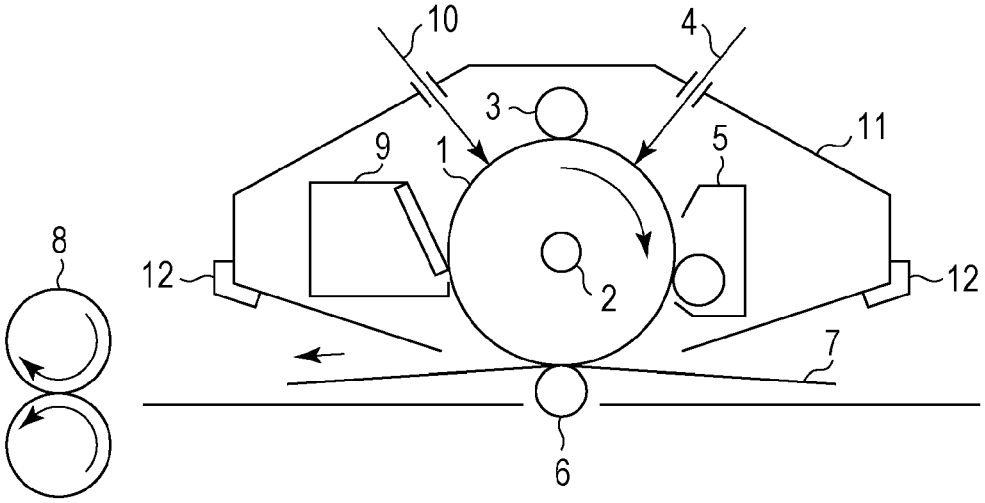
FIG. 2 is a diagram schematically showing an example of the structure of an electrophotographic apparatus provided with a process cartridge including an electrophotographic photosensitive member.

FIG. 2 schematically shows an example of the structure of an electrophotographic apparatus having a process cartridge including an electrophotographic photosensitive member according to an aspect of the present invention.

In FIG. 2, an electrophotographic photosensitive member 1 of the present invention is cylindrical (drum-like) and rotates at a predetermined peripheral velocity (process speed) in the direction of the arrow with a shaft 2 as a rotation center.

The surface (circumference surface) of the electrophotographic photosensitive member 1 is charged to a predetermined positive or negative potential with a charging device 3 (primary charging device: e.g., charging roller) during the rotation process.

Subsequently, the surface of the electrophotographic photosensitive member 1 is irradiated with exposure light 4 (image exposure light) from an exposing device (image exposing device) (not shown). Thus, an electrostatic latent image is formed on the surface of the electrophotographic photosensitive member 1.

The electrostatic latent image formed on the surface of the electrophotographic photosensitive member 1 is subjected to development (normal development or reversal development) with a developer (toner) in a developing device 5 to form a toner image on the surface of the electrophotographic photosensitive member 1. Subsequently, the toner image formed on the surface of the electrophotographic photosensitive member 1 is transferred to a transfer material 7 by a transferring device 6 (e.g., a transfer roller).

The transfer material 7 is taken out from a transfer material supplying device (not shown) in synchronization with rotation of the electrophotographic photosensitive member 1 and is fed between the electrophotographic photosensitive member 1 and the transferring device 6 (contact portion). The transferring device 6 is applied with a voltage (transfer bias) having the polarity reverse to that of the toner by a bias power source (not shown).

The transfer material 7 to which the toner image has been transferred is separated from the surface of the electrophotographic photosensitive member 1 and is sent in a fixing device 8 to be subjected to toner-image-fixing treatment and then conveyed to the outside of the electrophotographic apparatus as an image-formed product (print, copy). The transferring device 6 may be of an intermediate transfer system including a primary transfer member, an intermediate transfer member, and a secondary transfer member.

The surface of the electrophotographic photosensitive member 1 after the transfer of the toner image to the transfer material 7 is cleaned with a cleaning device 9 (e.g., cleaning blade) to remove adhering matter such as post-transfer residual developer (post-transfer residual toner). The post-transfer residual toner may be collected with, for example, a developing device (cleanerless system).

Furthermore, the surface of the electrophotographic photosensitive member 1 is irradiated with pre-exposure light 10 from a pre-light exposing device (not shown) for neutralization treatment and is then used again for image formation. If the charging device 3 is a contact charging device using, for example, a charging roller as shown in FIG. 2, the pre-exposure is not necessarily required.

In the present invention, two or more components selected from the structural components, such as the electrophotographic photosensitive member 1, the charging device 3, the developing device 5, and the cleaning device 9, may be integrally supported in a container as a process cartridge. This process cartridge may be detachably attachable to the main body of an electrophotographic apparatus. For example, the electrophotographic photosensitive member 1 and at least one device selected from the group consisting of the charging device 3, the developing device 5, the transferring device 6, and the cleaning device 9 are integrally supported to constitute a process cartridge 11 that is detachably attachable to the main body of an electrophotographic apparatus with a guiding device 12 such as a rail of the main body of the electrophotographic apparatus. Examples of the exposure light 4 include reflected light and transmitted light from a copy and light irradiated by, for example, scanning of laser beams, driving of an LED array, or driving of a liquid crystal shutter array that is performed according to signals converted by reading the information of a copy with a sensor.

EXAMPLES

The present invention will now be described in more detail by Examples, but is not limited thereto. Note that "part(s)" in Examples means "part(s) by mass".

Example 1

An aluminum cylinder having a diameter of 30 mm and a length of 357.5 mm was used as a support (electrically conductive support).

Subsequently, 100 parts of zinc oxide particles (average particle diameter: 70 nm, specific surface area: 15 $m^2/g$, powder resistance: $3.7\times10^5$ Ω·cm) and 500 parts of toluene were mixed with stirring. To the mixture was added 1.5 parts of a silane coupling agent, N-(2-aminoethyl)-3-aminopropyltrimethoxysilane (trade name: KBM603, manufactured by Shin-Etsu Chemical Co., Ltd.), followed by stirring for 6 h. Subsequently, toluene was distilled under reduced pressure, and the residue was dried by heating at 140° C. for 6 h to give zinc oxide particles whose surfaces were treated with the silane coupling agent.

Subsequently, 15 parts of a butyral resin (trade name: BM-1, manufactured by Sekisui Chemical Co., Ltd.) as a polyol resin and 15 parts of blocked isocyanate (trade name: Desmodur BL3175/1, manufactured by Sumika Bayer Urethane Co., Ltd.) were dissolved in a solvent mixture of 73.5 parts of methyl ethyl ketone and 73.5 parts of 1-butanol. To the resulting solution were added 81 parts of the zinc oxide particles whose surfaces were treated with the silane coupling agent, 0.8 parts of alizarin (manufactured by Tokyo Chemical Industry Co., Ltd.), and 0.81 parts of zinc octylate (trade name: Nikkaoctics Zinc Zn 8%, manufactured by Nihon Kagaku Sangyo Co., Ltd.). The mixture was subjected to dispersion treatment with a sand mill using glass beads of 0.8 mm diameter at an atmospheric temperature of 23±3° C. for 3 h. To the resulting mixture were added 0.01 parts of silicone oil (trade name: SH28PA, manufactured by Dow Corning Toray Co., Ltd.) and 5.6 parts of silicone resin particles (trade name: Tospearl 145, manufactured by GE Toshiba Silicone Co., Ltd.), followed by stirring to prepare a coating liquid for an undercoat layer. The blocking agent possessed by the blocked isocyanate (Desmodur BL3175/1) was an oxime derivative.

This coating liquid for an undercoat layer was applied to the above-mentioned support to form a coating film. The resulting coating film was dried and cured at 155° C. for 30 min to form an undercoat layer having a thickness of 20 μm.

Subsequently, 2 parts of polyvinyl butylal (trade name: S-Lek BX-1, manufactured by Sekisui Chemical Co., Ltd.) was dissolved in 100 parts of cyclohexane. To this solution were added 4 parts of hydroxygallium phthalocyanine crystals (charge-generating material) having a crystal form exhibiting strong peaks at a Bragg angle 2θ±0.2° of 7.4° and a Bragg angle 2θ±0.2° of 28.1° in the CuKα characteristic X-ray diffraction and 0.04 parts of a compound represented by the following structural formula (A):

(A)

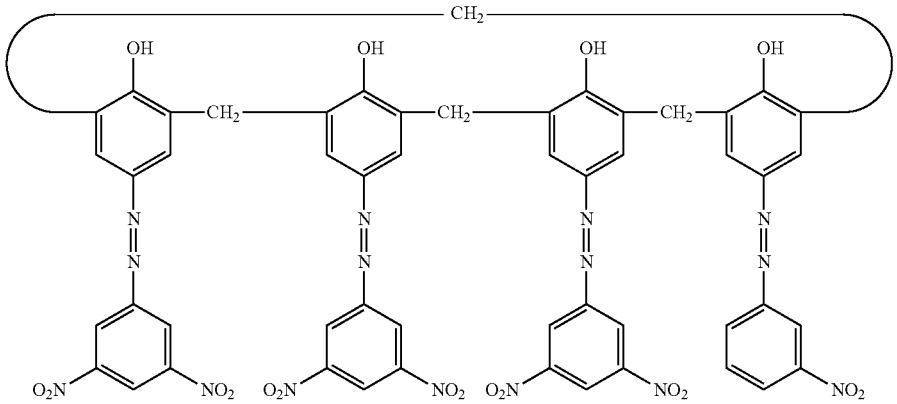

The mixture was subjected to dispersion treatment with a sand mill using glass beads of 1 mm diameter at an atmospheric temperature of 23±3° C. for 1 h. After the dispersion treatment, 100 parts of ethyl acetate was added to the resulting dispersion to prepare a coating liquid for a charge-generating layer.

This coating liquid for a charge-generating layer was applied onto the undercoat layer by dipping to form a coating film. The resulting coating film was dried at 90° C. for 10 min to form a charge-generating layer having a thickness of 0.20 μm.

Subsequently, a coating liquid for a charge-transporting layer was prepared by dissolving 50 parts of an amine compound (charge-transporting material (hole-transporting material)) represented by the following structural formula (B):

(B)

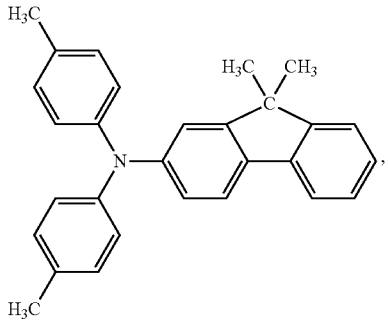

50 parts of an amine compound (charge-transporting material (hole-transporting material)) represented by the following structural formula (C):

(C)

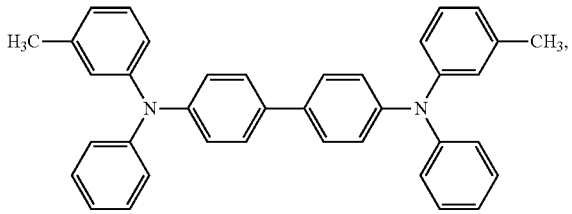

and 100 parts of a polycarbonate (trade name: Iupilon 2400, manufactured by Mitsubishi Gas Chemical Company, Inc.) in a solvent mixture of 650 parts of chlorobenzene and 150 parts of dimethoxymethane.

This coating liquid for a charge-transporting layer was left to stand for one day. Subsequently, the coating liquid for a charge-transporting layer was applied onto the charge-generating layer by dipping to form a coating film. The resulting coating film was dried at 110° C. for 30 min to form a charge-transporting layer having a thickness of 21 μm.

Subsequently, 36 parts of a compound represented by the following structural formula (D):

(D)

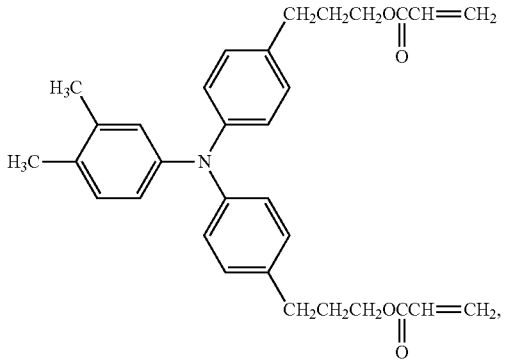

4 parts of polytetrafluoroethylene particles (trade name: Lubron L-2, manufactured by Daikin Industries, Ltd.), and 60 parts of n-propyl alcohol were mixed. The mixture was subjected to dispersion treatment with an ultra-high pressure disperser to prepare a coating liquid for a protective layer (coating liquid for a second charge-transporting layer).

This coating liquid for a protective layer was applied onto the charge-transporting layer by dipping to form a coating film. The resulting coating film was dried at 50° C. for 5 min. After the drying, the coating film was irradiated with electron rays at an accelerating voltage of 70 kV and an absorbed dose of 8000 Gy for 1.6 sec under a nitrogen atmosphere, while the support was being rotated. The coating film was then heat-treated under a nitrogen atmosphere such that the temperature of the coating film was maintained at 130° C. for 3 min. The oxygen concentration during the treatment from the irradiation with electron rays to the heat treatment for 3 min was 20 ppm. Subsequently, the coating film was heat-treated in the air such that the temperature of the coating film was maintained at 100° C. for 30 min to form a protective layer (second charge-transporting layer) having a thickness of 5 μm.

Thus, a cylindrical electrophotographic photosensitive member (photosensitive drum) having a support, an undercoat layer, a charge-generating layer, a charge-transporting layer, and a protective layer (second charge-transporting layer) in this order was produced.

The evaluation will now be described.

Evaluation of Variation in Light Potential by Repeating Use

A copier (trade name: GP405) of an electrophotographic system manufactured by CANON KABUSHIKI KAISHA was modified such that the process speed was 300 mm/s and that the charging device was a system for applying a voltage obtained by superimposing an AC voltage on a DC voltage to the charging roller and was used for evaluation. The electrophotographic photosensitive member produced above was mounted on the drum cartridge of the apparatus for evaluation, and evaluation was carried out as follows.

The apparatus for evaluation was set up under an ordinary temperature and ordinary humidity (23° C./50% RH) environment or under a high temperature and high humidity (30° C./85% RH) environment. The charging was carried out under conditions such that the peak-to-peak voltage of AC component of the voltage applied to the charging roller was 1500 V, the frequency was 1500 Hz, and the DC component was −850 V. The exposure conditions were controlled such that the initial light potential ($Vl_A$) (before the repeating use) when the surface of an electrophotographic photosensitive member was irradiated with laser beams as image exposure light was −200 V. The control of the exposure conditions was performed for each electrophotographic photosensitive member including the electrophotographic photosensitive members of Examples and Comparative Examples described below.

The surface potential of an electrophotographic photosensitive member was measured by drawing out the development cartridge from the evaluation apparatus, fixing a potential probe (trade name: model 6000B-8, manufactured by Trek Co., Ltd.) thereto, and connecting a surface potentiometer (trade name: model 344, manufactured by Trek Co., Ltd.) to this. The potential probe was plated at the center relative to the electrophotographic photosensitive member in the axial direction of the electrophotographic photosensitive member and so as to be apart from the surface of the electrophotographic photosensitive member by 3 mm.

The evaluation will now be described. The evaluation was performed without changing the charging conditions and the exposure conditions that were set at the beginning.

The electrophotographic photosensitive member was left to stand under an ordinary temperature and ordinary humidity (23° C./50% RH) environment for 24 h. Subsequently, the electrophotographic photosensitive member was mounted on a drum cartridge, and the drum cartridge was attached to the evaluation apparatus, followed by image output on 50000 sheets (repeating use of the electrophotographic photosensitive member by continuous feeding).

After the image output on 50000 sheets, the evaluation apparatus was left to stand for 5 min, and the cartridge for development was replaced with a potential measuring apparatus composed of the potential probe and the surface potentiometer. The light potential ($Vl_{NB}$) of the surface of the electrophotographic photosensitive member after image output on 50000 sheets (after repeating use) was measured to calculate the variation amount, $\Delta Vl_N$ ($\Delta Vl_N=|Vl_{NB}|-|Vl_{NA}|$), in light potential of the surface of the electrophotographic photosensitive member by the repeating use, wherein $Vl_{NA}$ denotes the light potential of the surface of the electrophotographic photosensitive member before the repeating use (initial light potential); and $|Vl_{NB}|$ and $|Vl_{NA}|$ denote the absolute values of $Vl_{NB}$ and $Vl_{NA}$, respectively.

The electrophotographic photosensitive member produced under the same conditions above was left to stand under a high temperature and high humidity (30° C./85% RH) environment for 72 h. Subsequently, the electrophotographic photosensitive member was mounted on a drum cartridge, and the drum cartridge was attached to the evaluation apparatus, followed by image output on 50000 sheets (repeating use of the electrophotographic photosensitive member by continuous feeding).

After the image output on 50000 sheets, the evaluation apparatus was left to stand for 5 min, and the cartridge for development was replaced with a potential measuring apparatus composed of the potential probe and the surface potentiometer. The light potential ($Vl_{HB}$) of the surface of the electrophotographic photosensitive member after image output on 50000 sheets (after repeating use) was measured to calculate the variation amount, $\Delta Vl_H$ ($\Delta Vl_H=|Vl_{HB}|-|Vl_{HA}|$), in light potential of the surface of the electrophotographic photosensitive member by the repeating use, wherein $Vl_{NA}$ denotes the light potential of the surface of the electrophotographic photosensitive member before the repeating use (initial light potential); and $|Vl_{HB}|$ and denote the absolute values of $Vl_{HB}$ and $Vl_{HA}$, respectively.

The difference $\Delta Vl$ ($\Delta Vl=|\Delta Vl_H|-|Vl_N|$) between the variation amount ($\Delta Vl_N$) in light potential by repeating use under the ordinary temperature and ordinary humidity (23° C./50% RH) environment and the variation amount ($\Delta Vl_H$) in light potential by repeating use under the high temperature and high humidity (30° C./85% RH) environment was evaluated, wherein $|\Delta Vl_N|$ and $|Vl_N|$ denotes the absolute values of $\Delta Vl_H$ and $Vl_N$, respectively. The results are shown in Table 1.

Example 2

An electrophotographic photosensitive member was produced as in Example 1 except that 0.81 parts of bismuth octylate (trade name: PUCAT 25 Bi 25%, manufactured by Nihon Kagaku Sangyo Co., Ltd.) was used instead of 0.81 parts of the zinc octylate contained in the coating liquid for an undercoat layer in Example 1, and was evaluated. The results are shown in Table 1.

Example 3

An electrophotographic photosensitive member was produced as in Example 1 except that 0.81 parts of cobalt octylate (trade name: Nikkaoctics Cobalt, manufactured by Nihon Kagaku Sangyo Co., Ltd.) was used instead of 0.81 parts of the zinc octylate contained in the coating liquid for an undercoat layer in Example 1, and was evaluated. The results are shown in Table 1.

Example 4

An electrophotographic photosensitive member was produced as in Example 1 except that 0.81 parts of iron octylate (trade name: Nikkaoctics, manufactured by Nihon Kagaku Sangyo Co., Ltd.) was used instead of 0.81 parts of the zinc octylate contained in the coating liquid for an undercoat layer in Example 1, and was evaluated. The results are shown in Table 1.

Example 5

An electrophotographic photosensitive member was produced as in Example 1 except that 0.81 parts of zinc naphthenate (trade name: Naphthecs Zinc, manufactured by Nihon Kagaku Sangyo Co., Ltd.) was used instead of 0.81 parts of the zinc octylate contained in the coating liquid for an undercoat layer in Example 1, and was evaluated. The results are shown in Table 1.

Example 6

An electrophotographic photosensitive member was produced as in Example 1 except that 0.81 parts of bismuth naphthenate (trade name: PUCAT B7, manufactured by Nihon Kagaku Sangyo Co., Ltd.) was used instead of 0.81 parts of the zinc octylate contained in the coating liquid for an undercoat layer in Example 1, and was evaluated. The results are shown in Table 1.

Example 7

An electrophotographic photosensitive member was produced as in Example 1 except that 0.81 parts of cobalt naphthenate (trade name: Naphthecs Cobalt, manufactured by Nihon Kagaku Sangyo Co., Ltd.) was used instead of 0.81 parts of the zinc octylate contained in the coating liquid for an undercoat layer in Example 1, and was evaluated. The results are shown in Table 1.

Example 8

An electrophotographic photosensitive member was produced as in Example 1 except that 0.81 parts of iron naphthenate (trade name: Naphthecs Iron, manufactured by Nihon Kagaku Sangyo Co., Ltd.) was used instead of 0.81 parts of the zinc octylate contained in the coating liquid for an undercoat layer in Example 1, and was evaluated. The results are shown in Table 1.

Example 9

An electrophotographic photosensitive member was produced as in Example 1 except that the amount of the zinc octylate contained in the coating liquid for an undercoat layer was changed to 0.41 parts from 0.81 parts in Example 1, and was evaluated. The results are shown in Table 1.

Example 10

An electrophotographic photosensitive member was produced as in Example 1 except that the amount of the zinc octylate contained in the coating liquid for an undercoat layer was changed to 4.1 parts from 0.81 parts in Example 1, and was evaluated. The results are shown in Table 1.

Example 11

An electrophotographic photosensitive member was produced as in Example 1 except that the amount of the zinc octylate contained in the coating liquid for an undercoat layer was changed to 8.2 parts from 0.81 parts in Example 1, and was evaluated. The results are shown in Table 1.

Example 12

An electrophotographic photosensitive member was produced as in Example 1 except that the amount of the zinc octylate contained in the coating liquid for an undercoat layer was changed to 16 parts from 0.81 parts in Example 1, and was evaluated. The results are shown in Table 1.

Example 13

An electrophotographic photosensitive member was produced as in Example 2 except that the amount of the bismuth octylate contained in the coating liquid for an undercoat layer was changed to 0.41 parts from 0.81 parts in Example 2, and was evaluated. The results are shown in Table 1.

Example 14

An electrophotographic photosensitive member was produced as in Example 2 except that the amount of the bismuth octylate contained in the coating liquid for an undercoat layer was changed to 4.1 parts from 0.81 parts in Example 2, and was evaluated. The results are shown in Table 1.

Example 15

An electrophotographic photosensitive member was produced as in Example 2 except that the amount of the bismuth octylate contained in the coating liquid for an undercoat layer was changed to 8.2 parts from 0.81 parts in Example 2, and was evaluated. The results are shown in Table 1.

Example 16

An electrophotographic photosensitive member was produced as in Example 2 except that the amount of the bismuth octylate contained in the coating liquid for an undercoat layer was changed to 16 parts from 0.81 parts in Example 2, and was evaluated. The results are shown in Table 1.

Examples 17 to 24

Electrophotographic photosensitive members were produced as in Examples 1 to 8 except that 100 parts of the zinc oxide particles (specific surface area: 15 $m^2/g$, powder resistance: $3.7\times10^5$ Ω·cm) before surface treatment used for preparing the coating liquid for an undercoat layer in each of Examples 1 to 8 were changed to 100 parts of other zinc oxide particles (average particle diameter: 35 nm, specific surface area: 40 $m^2/g$, powder resistance: $1.6\times10^6$ Ω·cm) before surface treatment, and were evaluated. The results are shown in Table 1.

Example 25

An electrophotographic photosensitive member was produced as in Example 1 except that 15 parts of the butyral resin used for preparing the coating liquid for an undercoat layer in Example 1 was changed to 20 parts of another butyral resin (trade name: BM-S, manufactured by Sekisui Chemical Co., Ltd.), and was evaluated. The results are shown in Table 2.

Example 26

An electrophotographic photosensitive member was produced as in Example 1 except that 15 parts of the butyral resin used for preparing the coating liquid for an undercoat layer in Example 1 was changed to 17 parts of polyacryl polyol (trade name: Burnock WE-310, manufactured by DIC Corporation), and was evaluated. The results are shown in Table 2.

Example 27

An electrophotographic photosensitive member was produced as in Example 1 except that 15 parts of the butyral resin used for preparing the coating liquid for an undercoat layer in Example 1 was changed to 15 parts of another butyral resin (trade name: BX-1, manufactured by Sekisui Chemical Co., Ltd.), and was evaluated. The results are shown in Table 2.

Examples 28 to 31

Electrophotographic photosensitive members were produced as in Examples 1 to 4 except that 15 parts of the butyral resin used for preparing the coating liquid for an undercoat layer in each of Examples 1 to 4 was changed to 15 parts of another blocked isocyanate (trade name: Desmodur BL3575/1, manufactured by Sumika Bayer Urethane Co., Ltd.) and that the conditions for drying the coating film of the coating liquid for an undercoat layer were changed to at 150° C. for 20 min from at 155° C. for 30 min, and were evaluated. The results are shown in Table 2. The blocking agent possessed by the blocked isocyanate (Desmodur BL3575/1) was a pyrazole derivative.

Examples 32 to 39

Electrophotographic photosensitive members were produced as in Examples 9 to 16 except that 15 parts of the blocked isocyanate used for preparing the coating liquid for an undercoat layer in each of Examples 9 to 16 was changed to 15 parts of another blocked isocyanate (trade name: Desmodur BL3575/1) and that the conditions for drying the coating film of the coating liquid for an undercoat layer were changed to at 150° C. for 20 min from at 155° C. for 30 min, and were evaluated. The results are shown in Table 2.

Example 40

An electrophotographic photosensitive member was produced as in Example 1 except that 30 parts of a phenol resin (trade name: Plyophen J325, manufactured by DIC Corporation) was used instead of the butyral resin and the blocked isocyanate used for preparing the coating liquid for an undercoat layer in Example 1, and was evaluated as in Example 1. The results are shown in Table 2.

Example 41

An electrophotographic photosensitive member was produced as in Example 1 except that 15 parts of N-methoxy nylon and 3 parts of copolymer nylon were used instead of the butyral resin and the blocked isocyanate used for preparing the coating liquid for an undercoat layer in Example 1, that the conditions for drying the coating film of the coating liquid for an undercoat layer were changed to at 100° C. for 20 min from at 155° C. for 30 min, and that the thickness of the undercoat layer was changed to 2.0 μm, and was evaluated. The results are shown in Table 3.

Example 42

An electrophotographic photosensitive member was produced as in Example 1 except that 15 parts of an alkyd resin (trade name: Beckolite M-6401-50, manufactured by DIC Corporation) and 15 parts of a melamine resin (trade name: Super Beckamine G-821-60, manufactured by DIC Corporation) were used instead of the butyral resin and the blocked isocyanate used for preparing the coating liquid for an undercoat layer in Example 1 and that the thickness of the undercoat layer was changed to 2.0 μm, and was evaluated. The results are shown in Table 3.

Example 43

An electrophotographic photosensitive member was produced as in Example 1 except that the silane coupling agent used for preparing the coating liquid for an undercoat layer in Example 1 was changed to 1.5 parts of another silane coupling agent, N-(2-aminoethyl)-3-aminopropyl methyl dimethoxy silane, (trade name: KBM602, manufactured by Shin-Etsu Chemical Co., Ltd.), and was evaluated. The results are shown in Table 3.

Example 44

An electrophotographic photosensitive member was produced as in Example 43 except that 15 parts of the blocked isocyanate used for preparing the coating liquid for an undercoat layer in Example 43 was changed to 15 parts of another blocked isocyanate (Desmodur BL3575/1) and that the conditions for drying the coating film of the coating liquid for an undercoat layer were changed to at 150° C. for 20 min from at 155° C. for 30 min, and was evaluated. The results are shown in Table 3.

Example 45

An electrophotographic photosensitive member was produced as in Example 44 except that 0.8 parts of 2,3,4-trihydroxybenzophenone (manufactured by Tokyo Chemical Industry Co., Ltd.) was used instead of 0.8 parts of the alizarin contained in the coating liquid for an undercoat layer in Example 44, and was evaluated. The results are shown in Table 3.

Example 46

An electrophotographic photosensitive member was produced as in Example 45 except that 0.81 parts of bismuth octylate (PUCAT 25 Bi 25%) was used instead of 0.81 parts of the zinc octylate contained in the coating liquid for an undercoat layer in Example 45, and was evaluated. The results are shown in Table 3.

Example 47

An electrophotographic photosensitive member was produced as in Example 45 except that 5.6 parts of the silicone resin particles contained in the coating liquid for an undercoat layer in Example 45 were changed to 5.6 parts of other silicone resin particles (trade name: Tospearl 120, manufactured by GE Toshiba Silicone Co., Ltd.), and was evaluated. The results are shown in Table 3.

Example 48

An electrophotographic photosensitive member was produced as in Example 45 except that 5.6 parts of cross-linking polymethyl methacrylate (PMMA) particles (trade name: TECHPOLYMERSSX-102, manufactured by Sekisui Plastics Co., Ltd., average primary particle diameter: 2.5 μm) were used instead of 5.6 parts of the silicone resin particles in Example 45 and that the thickness of the undercoat layer was changed to 32 μm, and was evaluated. The results are shown in Table 3.

Reference Example 49

An electrophotographic photosensitive member was produced as in Example 1 except that 81 parts of titanium oxide particles coated with oxygen deficiency tin oxide ($SnO_2$) were used instead of 81 parts of the surface-treated zinc oxide particles contained in the coating liquid for an undercoat layer in Example 1, and was evaluated. The results are shown in Table 3. The titanium oxide particles coated with oxygen deficiency tin oxide had an average particle diameter of 70 nm, a specific surface area of 30 $m^2/g$, a powder resistance of 120 Ω·cm, and a coverage of tin oxide ($SnO_2$) of 40% (mass ratio).

Example 50

An electrophotographic photosensitive member was produced as in Example 1 except that 0.8 parts of the alizarin contained in the coating liquid for an undercoat layer in Example 1 was not used, and was evaluated. The results are shown in Table 3.

Example 51

An electrophotographic photosensitive member was produced as in Example 50 except that 30 parts of a phenol resin (Plyophen J325) was used instead of the butyral resin and the blocked isocyanate contained in the coating liquid for an undercoat layer in Example 50, and was evaluated. The results are shown in Table 3.

Example 52

An electrophotographic photosensitive member was produced as in Example 50 except that 15 parts of N-methoxy nylon and 3 parts of copolymer nylon were used instead of the butyral resin and the blocked isocyanate contained in the coating liquid for an undercoat layer in Example 50, that 5.6 parts of the silicone resin particles were not used, that the conditions for drying the coating film of the coating liquid for an undercoat layer were changed to at 100° C. for 20 min from at 155° C. for 30 min, and that the thickness of the undercoat layer was changed to 2.0 μm, and was evaluated. The results are shown in Table 3.

Example 53

An electrophotographic photosensitive member was produced as in Example 50 except that 12 parts of polyacryl polyol (Burnock WE-300) and 16 parts of blocked isocyanate (trade name: Takenate WB-920, manufactured by Mitsui Chemicals Polyurethanes, Inc.) were used instead of the butyral resin and the blocked isocyanate contained in the coating liquid for an undercoat layer in Example 50, that 5.6 parts of the silicone resin particles were not used, and that the thickness of the undercoat layer was changed to 2.0 μm, and was evaluated. The results are shown in Table 3. The blocking agent possessed by the blocked isocyanate (Takenate WB-920) was a lactam derivative.

Example 54

An electrophotographic photosensitive member was produced as in Example 53 except that 0.81 parts of bismuth octylate (PUCAT 25 Bi 25%) was used instead of 0.81 parts of the zinc octylate contained in the coating liquid for an undercoat layer in Example 53, and was evaluated. The results are shown in Table 3.

Example 55

An electrophotographic photosensitive member was produced as in Example 53 except that 0.81 parts of cobalt octylate (Nikkaoctics Cobalt) was used instead of 0.81 parts of the zinc octylate contained in the coating liquid for an undercoat layer in Example 53, and was evaluated. The results are shown in Table 3.

Example 56

An electrophotographic photosensitive member was produced as in Example 53 except that 0.81 parts of iron octylate (Nikkaoctics) was used instead of 0.81 parts of the zinc octylate contained in the coating liquid for an undercoat layer in Example 53, and was evaluated. The results are shown in Table 3.

Example 57

An electrophotographic photosensitive member was produced as in Example 53 except that 81 parts of zinc oxide particles (average particle diameter: 35 nm, specific surface area: 40 $m^2/g$, powder resistance: $1.6\times10^6$ Ω·cm) were used instead of 81 parts of the zinc oxide particles contained in the coating liquid for an undercoat layer in Example 53, and was evaluated. The results are shown in Table 3.

Example 58

An electrophotographic photosensitive member was produced as in Example 53 except that 70 parts of zinc oxide particles (average particle diameter: 50 mm, specific surface area: 30 $m^2/g$, powder resistance: $1.2\times10^5$ Ω·cm) were used instead of 81 parts of the zinc oxide particles contained in the coating liquid for an undercoat layer in Example 53 and that 1 part of water-soluble cellulose (trade name: Metolose 65SH-50, manufactured by Shin-Etsu Chemical Co., Ltd.) and 18 parts of a blocked isocyanate compound (trade name: Bayhydur VPLS2310, manufactured by Sumika Bayer Urethane Co., Ltd.) were used instead of 12 parts of the polyacryl polyol and 16 parts of the blocked isocyanate, and was evaluated. The results are shown in Table 3. The blocking agent possessed by the blocked isocyanate compound (Bayhydur VPLS2310) was a lactam derivative.

Example 59

An electrophotographic photosensitive member was produced as in Example 57 except that 10 parts of water-soluble nylon (trade name: Tresin FS350E5AS, manufactured by Nagase ChemteX Corporation) and 15 parts of blocked isocyanate (trade name: Takenate WB-820, manufactured by Mitsui Chemicals Polyurethanes, Inc.) were used instead of 12 parts of the polyacryl polyol and 16 parts of the blocked isocyanate contained in the coating liquid for an undercoat layer in Example 57, and was evaluated. The results are shown in Table 3. The blocking agent possessed by the blocked isocyanate (Takenate WB-820) was a lactam derivative.

Example 60

An electrophotographic photosensitive member was produced as in Example 42 except that 81 parts of titanium oxide particles whose surfaces were treated with N-(2-aminoethyl)-3-aminopropyltrimethoxysilane (trade name: KBM603, manufactured by Shin-Etsu Chemical Co., Ltd.) were used instead of 81 parts of the zinc oxide particles contained in the coating liquid for an undercoat layer in Example 42, and was evaluated. The results are shown in Table 3. The titanium oxide particles used had an average particle diameter of 70 nm, a specific surface area of 15 $m^2/g$, and a powder resistance of $7.8\times10^4$ Ω·cm.

Example 61

An electrophotographic photosensitive member was produced as in Example 60 except that 0.81 parts of bismuth octylate (PUCAT 25 Bi 25%) was used instead of 0.81 parts of the zinc octylate contained in the coating liquid for an undercoat layer in Example 60, and was evaluated. The results are shown in Table 4.

Example 62

An electrophotographic photosensitive member was produced as in Example 60 except that 0.81 parts of cobalt octylate (Nikkaoctics Cobalt) was used instead of 0.81 parts of the zinc octylate contained in the coating liquid for an undercoat layer in Example 60, and was evaluated. The results are shown in Table 4.

Example 63

An electrophotographic photosensitive member was produced as in Example 60 except that 0.81 parts of iron octylate (Nikkaoctics) was used instead of 0.81 parts of the zinc octylate contained in the coating liquid for an undercoat layer in Example 60, and was evaluated. The results are shown in Table 4.

Example 64 to 68

Electrophotographic photosensitive members were produced as in Examples 49 to 53 except that 81 parts of titanium oxide particles were used instead of 81 parts of the zinc oxide particles contained in the coating liquid for an undercoat layer in each of Examples 49 to 53, and were evaluated. The results are shown in Table 4. The titanium oxide particles used had an average particle diameter of 70 nm, a specific surface area of 15 $m^2/g$, and a powder resistance of $3.2\times10^5$ Ω·cm.

Example 69

An electrophotographic photosensitive member was produced as in Example 60 except that 81 parts of zinc oxide particles were used instead of 81 parts of the titanium oxide particles contained in the coating liquid for an undercoat layer in Example 60, and was evaluated. The results are shown in Table 4. The zinc oxide particles used had an average particle diameter of 35 nm, a specific surface area of 40 $m^2/g$, and a powder resistance of $1.6\times10^6$ Ω·cm.

Reference Example 70

An electrophotographic photosensitive member was produced as in Example 66 except that 81 parts of tin oxide particles doped with antimony were used instead of 81 parts of the titanium oxide particles contained in the coating liquid for an undercoat layer in Example 66, and was evaluated. The results are shown in Table 4. The tin oxide particles doped with antimony had an average particle diameter of 50 nm, a specific surface area of 30 $m^2/g$, and a powder resistance of $6.9\times10^6$ Ω·cm.

Example 71

An electrophotographic photosensitive member was produced as in Example 1 except that 0.81 parts of nickel octylate (trade name: Nikkaoctics Nickel, manufactured by Nihon Kagaku Sangyo Co., Ltd.) was used instead of 0.81 parts of the zinc octylate contained in the coating liquid for an undercoat layer in Example 1, and was evaluated. The results are shown in Table 1.

Example 72

An electrophotographic photosensitive member was produced as in Example 1 except that 0.81 parts of copper naphthenate (trade name: Naphthecs Copper Cu 5%, manufactured by Nihon Kagaku Sangyo Co., Ltd.) was used instead of 0.81 parts of the zinc octylate contained in the coating liquid for an undercoat layer in Example 1, and was evaluated. The results are shown in Table 1.

Comparative Example 1

An electrophotographic photosensitive member was produced as in Example 1 except that 81 parts of the zinc oxide particles were not contained in the coating liquid for an undercoat layer in Example 1, and was evaluated. The results are shown in Table 5.

Comparative Example 2

An electrophotographic photosensitive member was produced as in Example 11 except that 81 parts of the zinc oxide particles were not contained in the coating liquid for an undercoat layer in Example 11, and was evaluated. The results are shown in Table 5.

Comparative Examples 3 to 5

Electrophotographic photosensitive members were produced as in Examples 2 to 4 except that 81 parts of the zinc oxide particles were not contained in the coating liquid for an undercoat layer in each of Examples 2 to 4, and were evaluated. The results are shown in Table 5.

Comparative Example 6

An electrophotographic photosensitive member was produced as in Example 1 except that 0.81 parts of the zinc octylate was not contained in the coating liquid for an undercoat layer in Example 1, and was evaluated. The results are shown in Table 5.

Comparative Examples 7 to 9

Electrophotographic photosensitive members were produced as in Examples 40 to 42 except that 0.81 parts of the zinc octylate was not contained in the coating liquid for an undercoat layer in each of Examples 40 to 42, and were evaluated. The results are shown in Table 5.

Comparative Example 10

An electrophotographic photosensitive member was produced as in Example 60 except that 0.81 parts of the zinc octylate was not contained in the coating liquid for an undercoat layer in Example 60, and was evaluated. The results are shown in Table 5.

Comparative Example 11

An electrophotographic photosensitive member was produced as in Example 64 except that 0.81 parts of the zinc octylate was not contained in the coating liquid for an undercoat layer in Example 64, and was evaluated. The results are shown in Table 5.

Comparative Examples 12 to 14

Electrophotographic photosensitive members were produced as in Examples 66 to 68 except that 0.81 parts of the zinc octylate was not contained in the coating liquid for an undercoat layer in each of Examples 66 to 68, and were evaluated. The results are shown in Table 5.

Comparative Example 15

An electrophotographic photosensitive member was produced as in Example 70 except that 0.81 parts of the zinc octylate was not contained in the coating liquid for an undercoat layer in Example 70, and was evaluated. The results are shown in Table 5.

Comparative Examples 16 and 17

Electrophotographic photosensitive members were produced as in Examples 71 and 72 except that 81 parts of the zinc oxide particles were not contained in the coating liquid for an undercoat layer in each of Examples 71 and 72, and were evaluated. The results are shown in Table 5.

TABLE 1

| | Undercoat layer | | | | | | |
|---|---|---|---|---|---|---|---|
| | Material | | | | | Film | |
| | (1) Metal oxide particles | (2) Binder resin | (3) Organic acid metal | Ratio to (1) [mass %] | (4) Other additive | thickness [μm] | ΔVI [V] |
| Example 1 | Zinc oxide particles | Urethane resin | Zinc octylate | 1 | Alizarin | 20 | 6 |
| Example 2 | Zinc oxide particles | Urethane resin | Bismuth octylate | 1 | Alizarin | 20 | 6 |
| Example 3 | Zinc oxide particles | Urethane resin | Cobalt octylate | 1 | Alizarin | 20 | 10 |
| Example 4 | Zinc oxide particles | Urethane resin | Iron octylate | 1 | Alizarin | 20 | 13 |
| Example 5 | Zinc oxide particles | Urethane resin | Zinc naphthenate | 1 | Alizarin | 20 | 12 |
| Example 6 | Zinc oxide particles | Urethane resin | Bismuth naphthenate | 1 | Alizarin | 20 | 12 |
| Example 7 | Zinc oxide particles | Urethane resin | Cobalt naphthenate | 1 | Alizarin | 20 | 16 |
| Example 8 | Zinc oxide particles | Urethane resin | Iron naphthenate | 1 | Alizarin | 20 | 16 |
| Example 9 | Zinc oxide particles | Urethane resin | Zinc octylate | 0.5 | Alizarin | 20 | 9 |
| Example 10 | Zinc oxide particles | Urethane resin | Zinc octylate | 5 | Alizarin | 20 | 5 |
| Example 11 | Zinc oxide particles | Urethane resin | Zinc octylate | 10 | Alizarin | 20 | 4 |
| Example 12 | Zinc oxide particles | Urethane resin | Zinc octylate | 20 | Alizarin | 20 | 4 |
| Example 13 | Zinc oxide particles | Urethane resin | Bismuth octylate | 0.5 | Alizarin | 20 | 9 |
| Example 14 | Zinc oxide particles | Urethane resin | Bismuth octylate | 5 | Alizarin | 20 | 5 |
| Example 15 | Zinc oxide particles | Urethane resin | Bismuth octylate | 10 | Alizarin | 20 | 4 |
| Example 16 | Zinc oxide particles | Urethane resin | Bismuth octylate | 20 | Alizarin | 20 | 4 |
| Example 17 | Zinc oxide particles | Urethane resin | Zinc octylate | 1 | Alizarin | 20 | 6 |
| Example 18 | Zinc oxide particles | Urethane resin | Bismuth octylate | 1 | Alizarin | 20 | 6 |
| Example 19 | Zinc oxide particles | Urethane resin | Cobalt naphthenate | 1 | Alizarin | 20 | 11 |
| Example 20 | Zinc oxide particles | Urethane resin | Iron naphthenate | 1 | Alizarin | 20 | 10 |

TABLE 2

| | Undercoat layer | | | | | | |
|---|---|---|---|---|---|---|---|
| | Material | | | | | Film | |
| | (1) Metal oxide particles | (2) Binder resin | (3) Organic acid metal | Ratio to (1) [mass %] | (4) Other additive | thickness [μm] | ΔVI [V] |
| Example 21 | Zinc oxide particles | Urethane resin | Bismuth naphthenate | 1 | Alizarin | 20 | 12 |
| Example 22 | Zinc oxide particles | Urethane resin | Zinc naphthenate | 1 | Alizarin | 20 | 12 |
| Example 23 | Zinc oxide particles | Urethane resin | Cobalt naphthenate | 1 | Alizarin | 20 | 17 |
| Example 24 | Zinc oxide particles | Urethane resin | Iron naphthenate | 1 | Alizarin | 20 | 18 |
| Example 25 | Zinc oxide particles | Urethane resin | Zinc octylate | 1 | Alizarin | 20 | 6 |
| Example 26 | Zinc oxide particles | Urethane resin | Zinc octylate | 1 | Alizarin | 20 | 7 |
| Example 27 | Zinc oxide particles | Urethane resin | Zinc octylate | 1 | Alizarin | 20 | 6 |
| Example 28 | Zinc oxide particles | Urethane resin | Zinc octylate | 1 | Alizarin | 20 | 8 |
| Example 29 | Zinc oxide particles | Urethane resin | Bismuth octylate | 1 | Alizarin | 20 | 6 |
| Example 30 | Zinc oxide particles | Urethane resin | Cobalt octylate | 1 | Alizarin | 20 | 16 |
| Example 31 | Zinc oxide particles | Urethane resin | Iron octylate | 1 | Alizarin | 20 | 15 |
| Example 32 | Zinc oxide particles | Urethane resin | Zinc octylate | 0.5 | Alizarin | 20 | 8 |
| Example 33 | Zinc oxide particles | Urethane resin | Zinc octylate | 5 | Alizarin | 20 | 6 |
| Example 34 | Zinc oxide particles | Urethane resin | Zinc octylate | 10 | Alizarin | 20 | 5 |
| Example 35 | Zinc oxide particles | Urethane resin | Zinc octylate | 20 | Alizarin | 20 | 5 |
| Example 36 | Zinc oxide particles | Urethane resin | Bismuth octylate | 1 | Alizarin | 20 | 8 |

TABLE 2-continued

| | Undercoat layer | | | | | | |
|---|---|---|---|---|---|---|---|
| | Material | | | | | Film | |
| | (1) Metal oxide particles | (2) Binder resin | (3) Organic acid metal | Ratio to (1) [mass %] | (4) Other additive | thickness [μm] | ΔVI [V] |
| Example 37 | Zinc oxide particles | Urethane resin | Bismuth octylate | 1 | Alizarin | 20 | 6 |
| Example 38 | Zinc oxide particles | Urethane resin | Bismuth octylate | 1 | Alizarin | 20 | 5 |
| Example 39 | Zinc oxide particles | Urethane resin | Bismuth octylate | 1 | Alizarin | 20 | 5 |
| Example 40 | Zinc oxide particles | Phenol resin | Zinc octylate | 1 | Alizarin | 20 | 8 |

TABLE 3

| | Undercoat layer | | | | | | |
|---|---|---|---|---|---|---|---|
| | Material | | | | | Film | |
| | (1) Metal oxide particles | (2) Binder resin | (3) Organic acid metal | Ratio to (1) [mass %] | (4) Other additive | thickness [μm] | ΔVI [V] |
| Example 41 | Zinc oxide particles | Amide resin | Zinc octylate | 1 | Alizarin | 2 | 25 |
| Example 42 | Zinc oxide particles | Alkyd melamine resin | Zinc octylate | 1 | Alizarin | 2 | 23 |
| Example 43 | Zinc oxide particles | Urethane resin | Zinc octylate | 1 | Alizarin | 20 | 8 |
| Example 44 | Zinc oxide particles | Urethane resin | Zinc octylate | 1 | Alizarin | 20 | 10 |
| Example 45 | Zinc oxide particles | Urethane resin | Zinc octylate | 1 | Benzophenone | 20 | 5 |
| Example 46 | Zinc oxide particles | Urethane resin | Bismuth octylate | 1 | Benzophenone | 20 | 7 |
| Example 47 | Zinc oxide particles | Urethane resin | Bismuth octylate | 1 | Benzophenone | 20 | 8 |
| Example 48 | Zinc oxide particles | Urethane resin | Bismuth octylate | 1 | Benzophenone | 20 | 7 |
| Reference Example 49 | Titanium oxide particles | Urethane resin | Zinc octylate | 1 | Alizarin | 32 | 10 |
| Example 50 | Zinc oxide particles | Urethane resin | Zinc octylate | 1 | None | 20 | 19 |
| Example 51 | Zinc oxide particles | Phenol resin | Zinc octylate | 1 | None | 20 | 14 |
| Example 52 | Zinc oxide particles | Amide resin | Zinc octylate | 1 | None | 2 | 14 |
| Example 53 | Titanium oxide particles | Urethane resin | Zinc octylate | 1 | None | 2 | 17 |
| Example 54 | Titanium oxide particles | Urethane resin | Bismuth octylate | 1 | None | 20 | 15 |
| Example 55 | Titanium oxide particles | Urethane resin | Cobalt octylate | 1 | None | 20 | 21 |
| Example 56 | Titanium oxide particles | Urethane resin | Iron octylate | 1 | None | 20 | 23 |
| Example 57 | Titanium oxide particles | Urethane resin | Zinc octylate | 1 | None | 20 | 9 |
| Example 58 | Titanium oxide particles | Urethane resin | Zinc octylate | 1 | None | 20 | 12 |
| Example 59 | Titanium oxide particles | Urethane resin | Zinc octylate | 1 | None | 20 | 11 |
| Example 60 | Titanium oxide particles | Alkyd melamine resin | Zinc octylate | 1 | None | 2 | 13 |

TABLE 4

| | Undercoat layer | | | | | | |
|---|---|---|---|---|---|---|---|
| | Material | | | | | Film | |
| | (1) Metal oxide particles | (2) Binder resin | (3) Organic acid metal | Ratio to (1) [mass %] | (4) Other additive | thickness [μm] | ΔVI [V] |
| Example 61 | Titanium oxide particles | Alkyd melamine resin | Bismuth octylate | 1 | None | 2 | 12 |
| Example 62 | Titanium oxide particles | Alkyd melamine resin | Cobalt octylate | 1 | None | 2 | 19 |
| Example 63 | Titanium oxide particles | Alkyd melamine resin | Iron octylate | 1 | None | 2 | 22 |
| Example 64 | Titanium oxide particles | Urethane resin | Zinc octylate | 1 | Alizarin | 20 | 10 |
| Example 65 | Titanium oxide particles | Urethane resin | Zinc octylate | 1 | None | 20 | 19 |
| Example 66 | Titanium oxide particles | Phenol resin | Zinc octylate | 1 | None | 20 | 17 |
| Example 67 | Titanium oxide particles | Amide resin | Zinc octylate | 1 | None | 2 | 26 |
| Example 68 | Titanium oxide particles | Urethane resin | Zinc octylate | 1 | None | 20 | 14 |
| Example 69 | Zinc oxide particles | Urethane resin | Zinc octylate | 1 | None | 20 | 13 |
| Reference Example 70 | Tin oxide particles doped with antimony | Phenol resin | Zinc octylate | 1 | None | 20 | 21 |
| Example 71 | Zinc oxide particles | Urethane resin | Nickel octylate | 1 | Alizarin | 20 | 8 |
| Example 72 | Zinc oxide particles | Urethane resin | Copper naphthenate | 1 | Alizarin | 20 | 9 |

TABLE 5

| | Undercoat layer | | | | | | |
|---|---|---|---|---|---|---|---|
| | Material | | | | | Film | |
| | (1) Metal oxide particles | (2) Binder resin | (3) Organic acid metal | Ratio to (1) [mass %] | (4) Other additive | thickness [μm] | ΔVI [V] |
| Comparative Example 1 | None | Urethane resin | Zinc octylate | — | Alizarin | 20 | 150 |
| Comparative Example 2 | None | Urethane resin | Zinc octylate | — | Alizarin | 20 | 140 |
| Comparative Example 3 | None | Urethane resin | Bismuth octylate | — | Alizarin | 20 | 150 |
| Comparative Example 4 | None | Urethane resin | Cobalt octylate | — | Alizarin | 20 | 160 |
| Comparative Example 5 | None | Urethane resin | Iron octylate | — | Alizarin | 20 | 150 |
| Comparative Example 6 | Zinc oxide particles | Urethane resin | None | 0 | Alizarin | 20 | 40 |
| Comparative Example 7 | Zinc oxide particles | Phenol resin | None | 0 | Alizarin | 20 | 80 |
| Comparative Example 8 | Zinc oxide particles | Amide resin | None | 0 | Alizarin | 2 | 90 |
| Comparative Example 9 | Zinc oxide particles | Alkyd melamine resin | None | 0 | Alizarin | 2 | 50 |
| Comparative Example 10 | Titanium oxide particles | Urethane resin | None | 0 | None | 20 | 100 |
| Comparative Example 11 | Titanium oxide particles | Phenol resin | None | 0 | None | 20 | 95 |
| Comparative Example 12 | Titanium oxide particles | Amide resin | None | 0 | None | 2 | 130 |
| Comparative Example 13 | Titanium oxide particles | Urethane resin | None | 0 | None | 2 | 110 |
| Comparative Example 14 | Titanium oxide particles | Alkyd melamine resin | None | 0 | None | 2 | 120 |
| Comparative Example 15 | Tin oxide particles doped with antimony | Phenol resin | None | 0 | Alizarin | 20 | 70 |
| Comparative Example 16 | None | Urethane resin | Nickel octylate | — | Alizarin | 20 | 150 |
| Comparative Example 17 | None | Urethane resin | Copper naphthenate | — | Alizarin | 20 | 140 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-263255, filed Nov. 30, 2012 and No. 2013-030117, filed Feb. 19, 2013, and No. 2013-219644, filed Oct. 22, 2013, which are hereby incorporated by reference herein in their entirety.

The invention claimed is:

1. An electrophotographic photosensitive member comprising:

a support;

an undercoat layer formed on the support; and a photosensitive layer formed on the undercoat layer, wherein the undercoat layer comprises:

metal oxide particles whose surfaces have been treated with a silane coupling agent;

a binder resin; and an organic acid metal salt being at least one selected from the group consisting of an organic acid bismuth salt, an organic acid zinc salt, an organic acid nickel salt, and an organic acid copper salt.

2. The electrophotographic photosensitive member according to claim 1, wherein the organic acid metal salt is a metal salt of monovalent carboxylic acid.

3. The electrophotographic photosensitive member according to claim 2, wherein the monovalent carboxylic acid is octylic acid, naphthenic acid, or salicylic acid.

4. The electrophotographic photosensitive member according to claim 1, wherein the binder resin is a urethane resin.

5. The electrophotographic photosensitive member according to claim 4, wherein the urethane resin is a polymer product of a composition containing a blocked isocyanate compound and a polyol, wherein the blocked isocyanate compound has a blocking agent being a pyrazole compound or a derivative thereof or a lactam compound or a derivative thereof.

6. The electrophotographic photosensitive member according to claim 1, wherein the metal oxide particles contain at least one metal oxide selected from the group consisting of zinc oxide, titanium oxide, and tin oxide.

7. The electrophotographic photosensitive member according to claim 1, wherein the silane coupling agent is an aminosilane coupling agent.

8. The electrophotographic photosensitive member according to claim 1, wherein a ratio (mass ratio) of the metal oxide particles to the binder resin (metal oxide particles/binder resin) contained in the undercoat layer is 1/1 or more and 4/1 or less.

9. The electrophotographic photosensitive member according to claim 1, wherein a ratio (mass ratio) of the organic acid metal salt to the metal oxide particles (organic acid metal salt/metal oxide particles) contained in the undercoat layer is 1/200 or more and 2/10 or less.

10. A process cartridge detachably attachable to a main body of an electrophotographic apparatus, wherein the process cartridge integrally supports:

an electrophotographic photosensitive member according to claim 1; and at least one device selected from the group consisting of charging devices, developing devices, transferring devices, and cleaning devices.

11. An electrophotographic apparatus comprising:

an electrophotographic photosensitive member according to claim 1, a charging device, an exposing device, a developing device, and a transferring device.

12. A method of producing an electrophotographic photosensitive member comprising a support, an undercoat layer formed on the support, and a photosensitive layer formed on the undercoat layer, the method comprising:

preparing a coating liquid for an undercoat layer containing:

metal oxide particles whose surfaces have been treated with a silane coupling agent, a blocked isocyanate compound, a polyol, and an organic acid metal salt being at least one selected from the group consisting of an organic acid bismuth salt, zinc salt, an organic acid nickel salt, and an organic copper salt; and forming a coating film of the coating liquid for an undercoat layer, and drying and curing the coating film to form the undercoat layer.

13. The method of producing an electrophotographic photosensitive member according to claim 12, wherein the organic acid metal salt is a metal salt of monovalent carboxylic acid.

14. The method of producing an electrophotographic photosensitive member according to claim 13, wherein the monovalent carboxylic acid is octylic acid, naphthenic acid, or salicylic acid.

15. The method of producing an electrophotographic photosensitive member according to claim 12, wherein the metal oxide particles contain at least one metal oxide selected from the group consisting of zinc oxide, titanium oxide, and tin oxide.

16. The method of producing an electrophotographic photosensitive member according to claim 12, wherein the silane coupling agent is an aminosilane coupling agent.

17. The method of producing an electrophotographic photosensitive member according to claim 12, wherein a ratio (mass ratio) of the organic acid metal salt to the metal oxide particles (organic acid metal salt/metal oxide particles) contained in the coating liquid for an undercoat layer is 1/200 or more and 2/10 or less.

18. The method of producing an electrophotographic photosensitive member according to claim 12, wherein the blocked isocyanate compound has a blocking agent being a pyrazole compound or a derivative thereof or a lactam compound or a derivative thereof.

* * * * *